US008984900B2

(12) United States Patent
Jeong et al.

(10) Patent No.: US 8,984,900 B2
(45) Date of Patent: Mar. 24, 2015

(54) REFRIGERATOR HAVING A DECORATIVE MEMBER CAPABLE OF DISPLAYING HUMIDITY AND METHOD FOR FABRICATING THE DECORATIVE MEMBER

(75) Inventors: Seok Jae Jeong, Changwon-si (KR); Young Kyu Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 484 days.

(21) Appl. No.: 13/390,296

(22) PCT Filed: Jan. 21, 2010

(86) PCT No.: PCT/KR2010/000388

§ 371 (c)(1),
(2), (4) Date: Feb. 13, 2012

(87) PCT Pub. No.: WO2011/027952

PCT Pub. Date: Mar. 10, 2011

(65) Prior Publication Data

US 2012/0138500 A1 Jun. 7, 2012

(30) Foreign Application Priority Data

Sep. 2, 2009 (KR) ..... 10-2009-0082499

(51) Int. Cl.

*F25D 21/02* (2006.01)
*F25D 29/00* (2006.01)
*F25D 17/04* (2006.01)

(52) U.S. Cl.

CPC ..... *F25D 21/02* (2013.01); *F25D 17/042* (2013.01); *F25D 29/005* (2013.01); *F25D 2317/04131* (2013.01); *F25D 2400/18* (2013.01); *F25D 2400/36* (2013.01)

USPC ..... 62/128; 62/264; 62/331

(58) Field of Classification Search

USPC ..... 62/128, 129, 249, 264, 407, 408, 285, 62/287, 291, 331; 73/29.01, 29.02, 29.04; 116/200; 165/907, 104, 26

See application file for complete search history.

(56) References Cited

U.S. PATENT DOCUMENTS

| | | | | | |
|---|---|---|---|---|---|
| 2,407,680 | A | * | 9/1946 | Palmquist et al. | 359/538 |
| 3,776,038 | A | * | 12/1973 | Elliott | 73/335.01 |
| 4,555,950 | A | * | 12/1985 | Danby et al. | 73/705 |
| 5,223,747 | A | * | 6/1993 | Tschulena | 257/713 |
| 5,224,373 | A | * | 7/1993 | Williams et al. | 73/29.02 |
| 6,953,551 | B2 | * | 10/2005 | Chen et al. | 422/504 |

(Continued)

FOREIGN PATENT DOCUMENTS

| | | | |
|---|---|---|---|
| CN | 100365362 | C | 1/2008 |
| DE | 247 502 | A1 | 7/1987 |

(Continued)

*Primary Examiner* — Cassey D Bauer
*Assistant Examiner* — Kun Kai Ma
(74) *Attorney, Agent, or Firm* — Birch, Stewart, Kolasch & Birch, LLP

(57) ABSTRACT

A decorative member of a refrigerator and a method for fabricating the same are disclosed. A refrigerator includes a storage container provided in a storage chamber; and a decorative member provided in the storage container, the decorative configured to generate light refraction and guide a movement of condensate condensed in the storage container, and configured to be capable of displaying humidity inside the storage container according to the movement degree of condensate.

11 Claims, 9 Drawing Sheets

(56) References Cited

U.S. PATENT DOCUMENTS

| | | | | |
|---|---|---|---|---|
| 2002/0128578 | A1* | 9/2002 | Johnston et al. | 602/43 |
| 2004/0069460 | A1* | 4/2004 | Sasaki et al. | 165/104.26 |
| 2004/0150329 | A1* | 8/2004 | Asai et al. | 313/506 |
| 2006/0016210 | A1* | 1/2006 | Lee et al. | 62/408 |
| 2007/0017258 | A1 | 1/2007 | Son et al. | |
| 2008/0184728 | A1 | 8/2008 | Horng et al. | |
| 2009/0013760 | A1* | 1/2009 | Chiba et al. | 73/29.04 |
| 2009/0232982 | A1* | 9/2009 | Ito et al. | 427/243 |
| 2009/0266145 | A1* | 10/2009 | Naydenova et al. | 73/29.04 |

FOREIGN PATENT DOCUMENTS

| | | | |
|---|---|---|---|
| JP | 2000-274922 | a | 10/2000 |
| JP | 2001-108354 | A | 4/2001 |
| JP | 2006-322261 | A | 11/2006 |
| WO | WO 2004/038311 | A1 | 5/2004 |

* cited by examiner (a)

(b)

(a)

(b)

(a)

(b)

(c)

(d)

REFRIGERATOR HAVING A DECORATIVE MEMBER CAPABLE OF DISPLAYING HUMIDITY AND METHOD FOR FABRICATING THE DECORATIVE MEMBER

TECHNICAL FIELD

The present invention relates to a refrigerator, more specifically, to a refrigerator having a decorative member enabling a user to recognize humidity of a storage chamber, with turbidity formed uniformly.

Background Art

Generally, refrigerators are electric appliances that are able to preserve storage objects fresh or frozen by using a refrigerant cycle configured of compression, condensation, expansion and evaporation. A structure of such a refrigerator includes a cabinet having a storage chamber, a door rotatably or sliding-movably coupled to the cabinet, and a shelf-type or drawer-type storage container installed in the storage chamber.

In addition, an evaporator and a cooling fan are mounted in the cabinet to exhaust cold air to the storage chamber. Such the configuration makes refrigerant to be sucked in the evaporator. Once the cooling fan rotates, the cold air is drawn into the storage chamber and the drawn cold air helps the storage objects preserved in the shelf and the storage container to be refrigerated and frozen freshly.

With trends of reconsidering designs of electric appliances, predetermined patterns or shapes trend to be introduced into external appearance and belonging parts of the electric appliances. For this, a predetermined pattern or shape is scratched in the external surface of the electric appliance on purpose.

To create such the scratch, thin sands have been blasted in a plastic injection-mold (referenced to as 'Sand Blasting') but this sand blasting method has difficulty in embodying uniform turbidity.

On the meanwhile, the drawer-type storage container provided in a refrigerator chamber composing the storage chamber is used to maintain humidity of the storage objects stored therein, for example, vegetables and fruits. The conventional refrigerator has no device enabling a user to recognize the humidity inside the storage chamber. As a result, the user cannot recognize how much the humidity is inside the storage container at the present.

Disclosure of Invention

Technical Problem

To solve the problems, an object of the present invention is to provide a refrigerator enabling a user to recognize and determine humidity inside a refrigerator conveniently.

Another object of the present invention is to provide a refrigerator capable of maintaining the humidity therein in a predetermined range.

A further object of the present invention is to provide a refrigerator capable of maintaining turbidity uniformly, if a predetermined configuration having turbidity to improve a design thereof.

Solution to Problem

To achieve these objects and other advantages and in accordance with the purpose of the invention, as embodied and broadly described herein, a refrigerator includes a storage container provided in a storage chamber; and a decorative member provided in the storage container, the decorative configured to generate light refraction and guide a movement of condensate condensed in the storage container, and configured to be capable of displaying humidity inside the storage container according to the movement degree of condensate.

The decorative member may include a path part formed in a capillary tube shape to generate a capillary phenomenon moving the movement of the condensate.

The path part may be configured to induce the refraction and the decorative member further may include a display plate comprising a plurality of path parts; a partition plate provided in rear of the display plate to cover rear portions of the path parts; and a transmitting part provided in a front portion of the display plate.

The path parts may be arranged vertically, spaced apart a predetermined distance from each other in parallel.

The path parts may be formed concavely in a rear surface of the display plate to fill condensate or air therein.

The path part may have a semicircular cross section to have a predetermined curvature.

The width of the path part may be 1~100μm to induce the capillary phenomenon and light refraction.

The decorative member may include an accommodation part provided below the display plate to accommodate condensate condensed from the humidity inside the storage container.

The accommodation part may include an accommodating groove accommodating dewdrops condensedly formed from the humidity and a wall surrounding the accommodating groove to prevent the dewdrops from overflowing.

The decorative member may be provided to display humidity inside the storage container according to the height of condensate lifted upward along the path parts.

The refrigerator may further include a humidity adjusting part provided in the storage container, the humidity adjusting part accommodating the moisture inside the storage container or discharging the accommodated moisture to adjust the humidity inside the storage container.

The humidity adjusting part may include an extended portion extended from a side wall of the storage container in a forward/rearward direction; a plurality of projections projected from the extended portion downward, spaced apart a predetermined distance from each other; and a plurality of accommodating spaces formed between the projections to accommodate the condensate.

In another aspect of the present invention, a method for fabricating a decorative member includes (A) step of fabricating a master stamp generating refraction of a light transmitted from outside, the master stamp comprising a pattern of a decorative member displaying humidity inside a storage container according to movement of water because of an osmotic pressure; (B) step of fabricating a replication mold replicating the pattern formed in the master stamp; (C) step of fabricating the decorative member by replicating the pattern formed in the replication mould in a predetermined injection-mold.

The (A) step may include (A-1) step of coating photoresist on a substrate; (A-2) step of forming a pattern corresponding to the pattern of the path part on the substrate by emitting a beam to a mask placed on the substrate having the photoresist coated thereon; (A-3) step of waiting for a predetermined time period until a section of the pattern formed by the photoresist is formed concave by a surface tension of the photoresist, and hardening the pattern; (A-4) step of depositing a predetermined metal seed layer on the pattern and the substrate; and (A-5) step of forming the master stamp having the pattern replicated therein by plating a predetermined metal different from the metal seed layer on the deposited metal seed layer.

Advantageous Effects of Invention

The present invention has following advantageous effects. According to the present invention, the relative amount of humidity inside the storage container may be known efficiently according to the amount of condensate lifted upward inside the decorative member by the capillary phenomenon, the condensate condensedly formed from the humidity.

Furthermore, if the humidity inside the storage container is too much, the humidity adjusting part provided in the storage container performs a moisture sorption function to prevent the humidity from increasing too high. If the humidity is reduced too much, the humidity adjusting part performs a moisture-proofing function to maintain the humidity in a predetermined range.

A still further, if a configuration having a predetermined turbidity to improve a design, such a turbidity may be formed uniformly and the providing of such the uniform turbidity may be embodied by standardization and mass-productivity.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

MODE FOR THE INVENTION

As follows, a refrigerator according to an exemplary embodiment of the present invention will be described in reference to the accompanying drawings.

Figure 1:
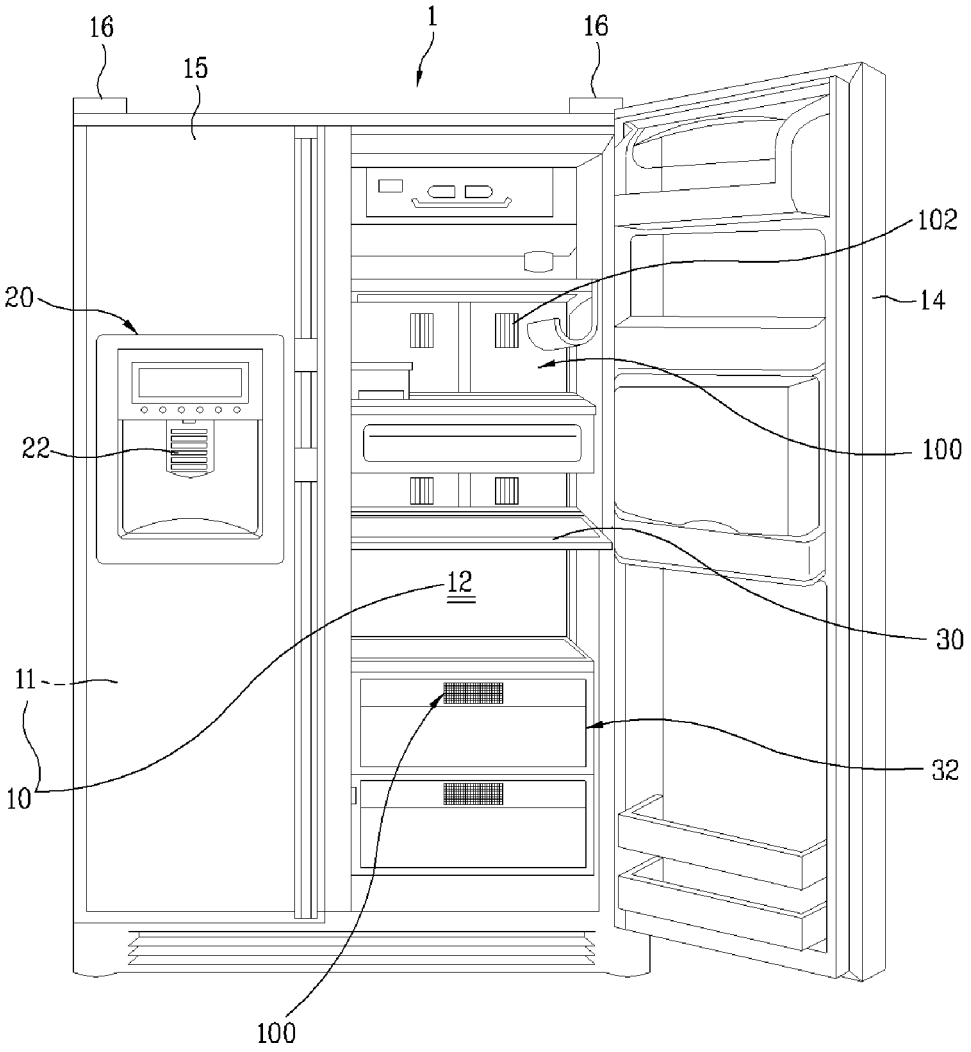
FIG. 1 is a front view illustrating a refrigerator according to an exemplary embodiment of the present invention.

As shown in FIG. 1, a refrigerator according to the exemplary embodiment of the present invention includes a cabinet 1, a storage chamber 10 provided in the cabinet 1 and doors 14 and 15 closing the storage chamber 10. The storage chamber 10 is configured of a refrigerator compartment 12 and a freezer compartment 11.

A hinge device 16 is provided on the cabinet to install and support the doors 14 and 15 rotatably.

A shelf 30 and a storage container 32 are provided in the storage chamber 10 to allow storage objects put thereon and therein, respectively.

Here, the storage container 32 may be provided in a drawer-type and the present invention is not limited thereto. The storage container 32 may define predetermined space capable of accommodating storage objects additionally.

Figure 2:
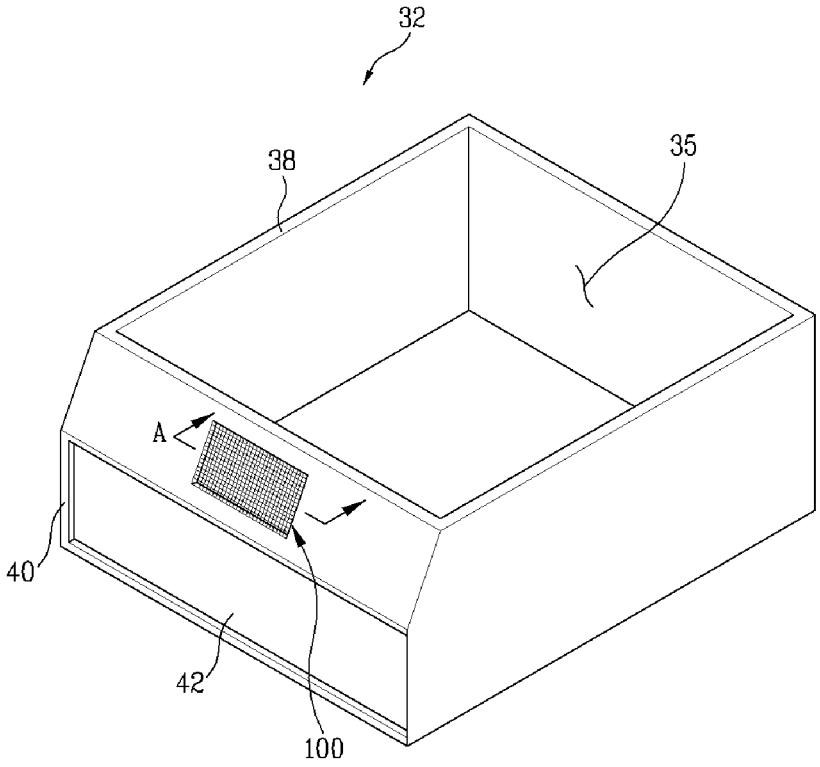
FIG. 2 is a perspective view illustrating a storage container provided in the refrigerator.

As shown in FIG. 2, the storage container 32 includes a storage space 35 and a surrounding wall 38 surrounding the storage space 35. A transparent window 42 is provided in a front wall 40 to make visible the storage objects accommodated in the storage space 35.

A decorative member 100 is provided in an upper portion of the front wall 40 to decorate external appearance of the storage container 32 as well as to display humidity inside the storage container 32.

The decorative member 100 has a structure capable of generating refraction of lights when lights are incident outside thereon.

The light refraction seen from the decorative member 100 creates difference between colors shown there from and colors shown from the other surfaces of the storage container 32. This color difference generates external appearance difference enough to create a kind of an aesthetic quality.

The decorative member 100 includes capillary-shaped tubes provided therein densely and if it is seen from outside, it seems to present uniform turbidity.

If dewdrops form near the decorative member 100 because of humidity condensate inside the storage container 32, the dewdrops ascends along the capillary-shaped tubes formed in the decorative member 100.

That is, the dewdrops are lifted upward by the capillary phenomenon and a degree of the water ascending lets the user to know the humidity inside the storage container 32.

Figure 3:
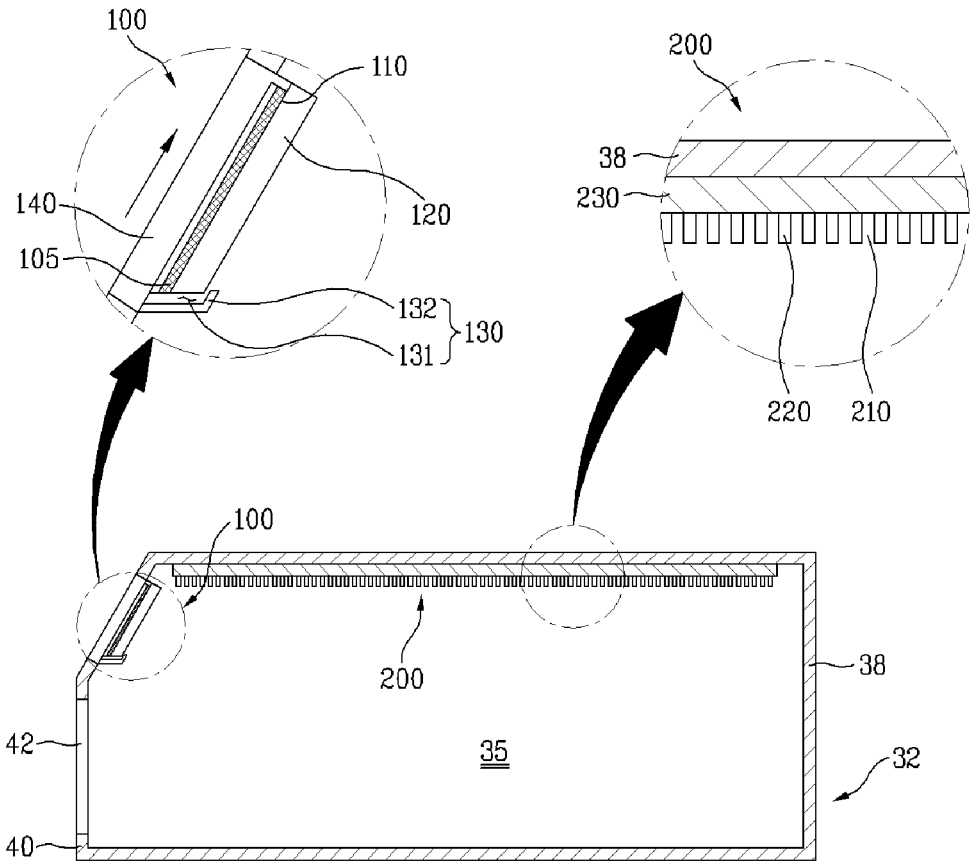
FIG. 3 is a side-sectional view illustrating the storage container.

As shown in FIG. 3, the decorative member 100 is provided in a rear surface of the upper portion of the front wall 40 provided in the storage container 32.

The decorative member 100 includes a display plate 110 and a partition plate 120 and an accommodation part 130. The display plate 110 has a path part 105 and the path part 105 generates the capillary phenomenon as well as the refraction to induce the ascending water. The partition plate 120 is provided in rear of the display plate 110 to partition off a rear portion of the path part 105. The accommodation part 130 is provided below the display plate 110 to receive dewdrops condensed from some of the humidity inside the storage container 32.

Here, the display plate 110 may be formed of resin material and a transmitting part 140 formed of transparent or semi-transparent material is provided in a front surface of the display plate 110.

As a result, the display plate 110 is provided in front of the path part 105 and the partition plate 120 is provided in rear of the path part 105, such that all the portions except a lower portion of the path part 105 may be closed.

The accommodation part 130 includes an accommodating groove 131 accommodating the dewdrops condensed from the humidity and a wall 132 surrounding the accommodating groove 131 to prevent the accommodated condensate from overflowing.

A humidity adjusting part 200 is provided in the storage container 32 to maintain the humidity inside the storage container 32 in a predetermined range.

The humidity adjusting part 200 includes an accommodating space 210 accommodating minute water particles composing the humidity and projections 220 defining the accommodating space 210, with spaced apart a predetermined distance from each other.

The projections 220 are provided in an extended part 230 extended forward and rearward.

Here, the accommodating space 210 is open downward such that the water particles may be drawn or the accommodated particles may be discharged via the open portion.

Figure 4:
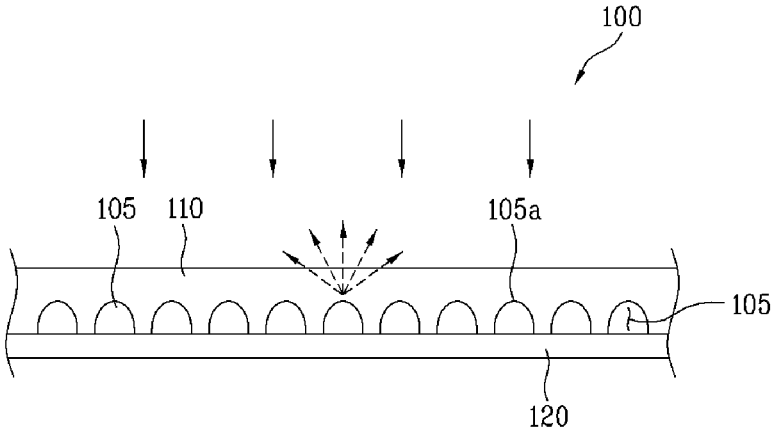
FIG. 4 is a longitudinal-sectional view illustrating a decorative member provided in the refrigerator.
Figure 4:
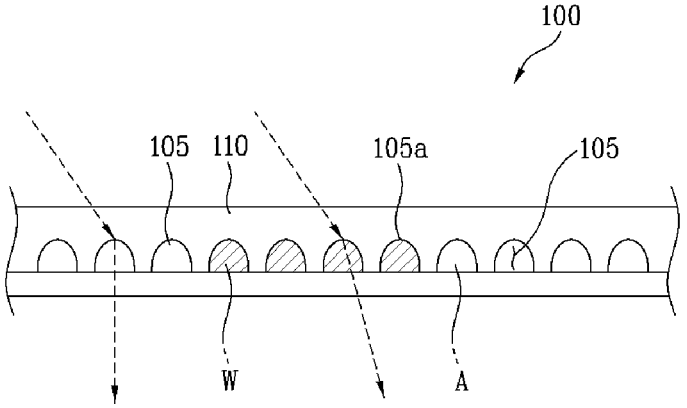

FIGS. 4A and 4B are diagrams illustrating a sectional view of the decorative member which is an arrow referenced to as A in FIG. 2. A plurality of path parts 105 of the decorative member 100 are provided distant from each other rightward/leftward. The flow of water drawn into one of the path parts 105 may not be affected by the flow of water drawn into another one.

Here, the cross section of the path part 105 may be semicircular-shaped and it may be concave toward a front surface of the display plate (110, see FIG. 2).

Of course, the cross section of the path part 105 is not limited to the semicircular shape and it may be a polygon shape including triangle and rectangular shapes.

This is because reflection should occur on a surface of the concave part 105*a* of the path part 105 and because refraction should occur in the concave part 105*a* at the same time.

That is, the display part 140 is formed of plastic material and the inside of the path part is filled with air, without water.

A refraction index of the display part 140 is approximately 1.5 and a refraction index of air is 1. As a result, the light transmitting the display part 140 is reflected as passing the concave part 105*a* of the path part 105 such that the decorative member 100 may be seen semitransparent or opaque from the outside.

At this time, if the condensate (W) is filling up the path part 105 because of the capillary phenomenon, such the refraction index may be weakened.

Since the refraction index of water is approximately 1.33, the reflection generated between the display plate 140 and the water is smaller than the reflection generated between the display plate and the air.

As a result, the opaque or semitransparent state formed without the water may be relieved when the water is filling up. Predetermined ones of the path part 105 filled up with the condensate (W) looks distinguished from the other ones of the path parts 105 filled up with the air (A).

In the meanwhile, as a radius of curvature of the path part 105 is getting smaller, the depth of focus of the refraction is getting closer enough to enlarge the refraction effect. As the path parts 105 are arranged closer to each other, the density of the path parts 105 is getting higher enough to enlarge the overall refraction amount of the light, such that the turbidity of the decorative member 100 may be increased.

Figure 5:
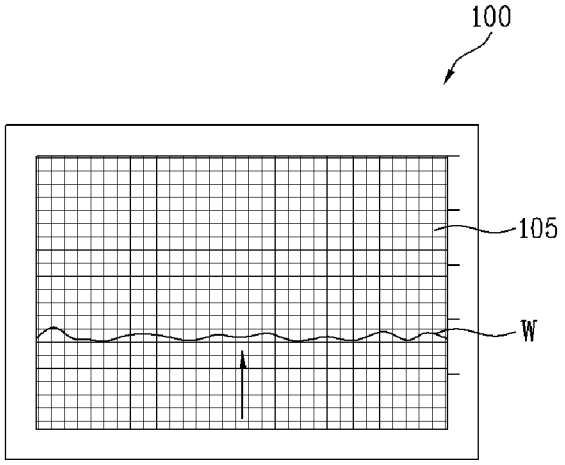
FIG. 5 is a front view illustrating the decorative member.
Figure 5:
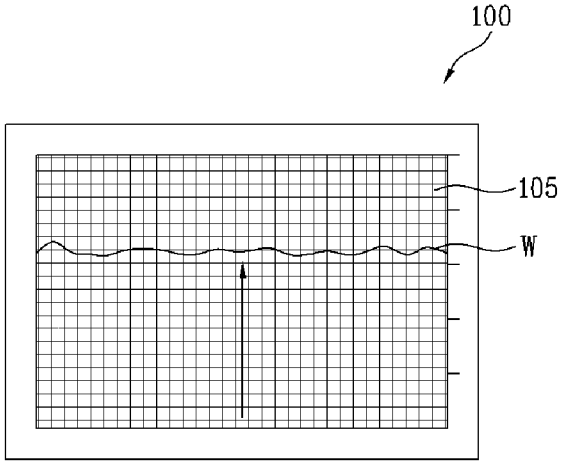

In case the humidity inside the storage container is maintained to a predetermined degree as shown in FIG. 5A, the predetermined amount of the condensate (W) condensed in the decorative member 100 may be lifted upward along the path part 105 by the capillary phenomenon.

However, if the humidity inside the storage container is increased higher as shown in FIG. 5B than the above humidity, the amount of the condensate (W) condensed in the decorative member 100 cannot but increase such that more condensate (W) may be lifted upward along the path part.

Because of that, the user may recognize relative change of the humidity efficiently.

Here, the width of the path part 105 may be approximately 1~100μm to generate the capillary phenomenon.

Here, the width of the path parts 105 may be identical or in a predetermined range to allow the display plate 110 seen from outside to have the uniform turbidity.

Figure 6:
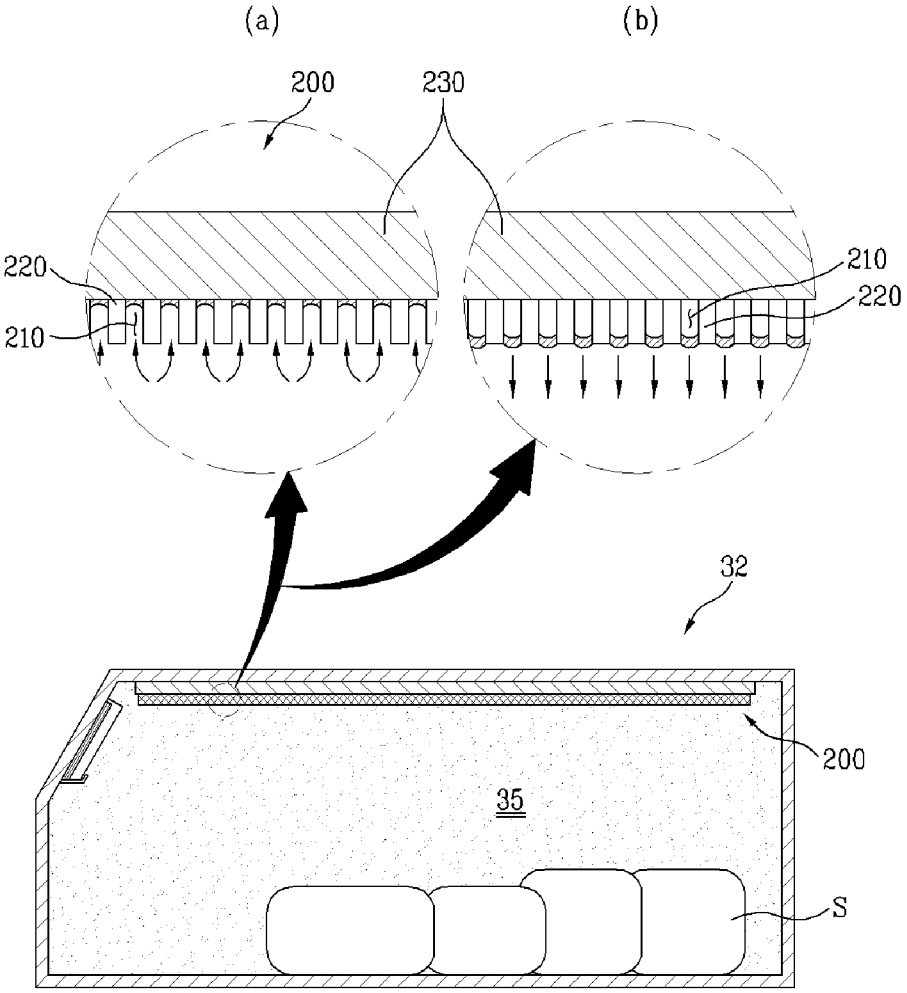
FIG. 6 is a side-sectional view illustrating operation of a humidity adjusting part of the storage container.
Figure 7:
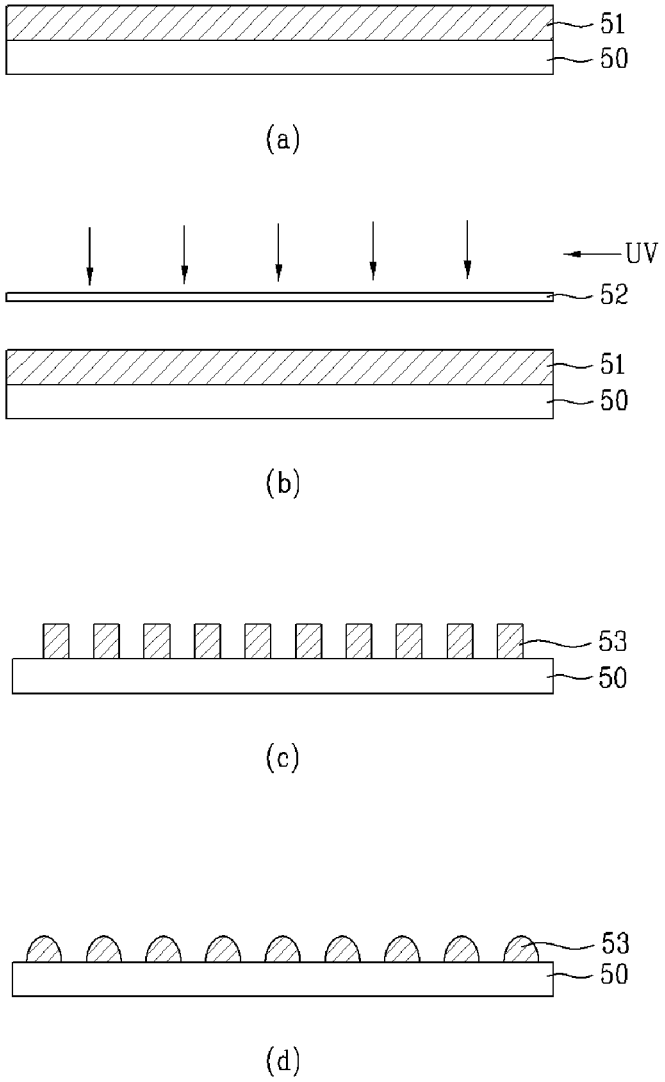
FIGS. 7 to 9 are diagrams illustrating a method for fabricating the decorative member of the refrigerator according to the present invention.
Figure 8:
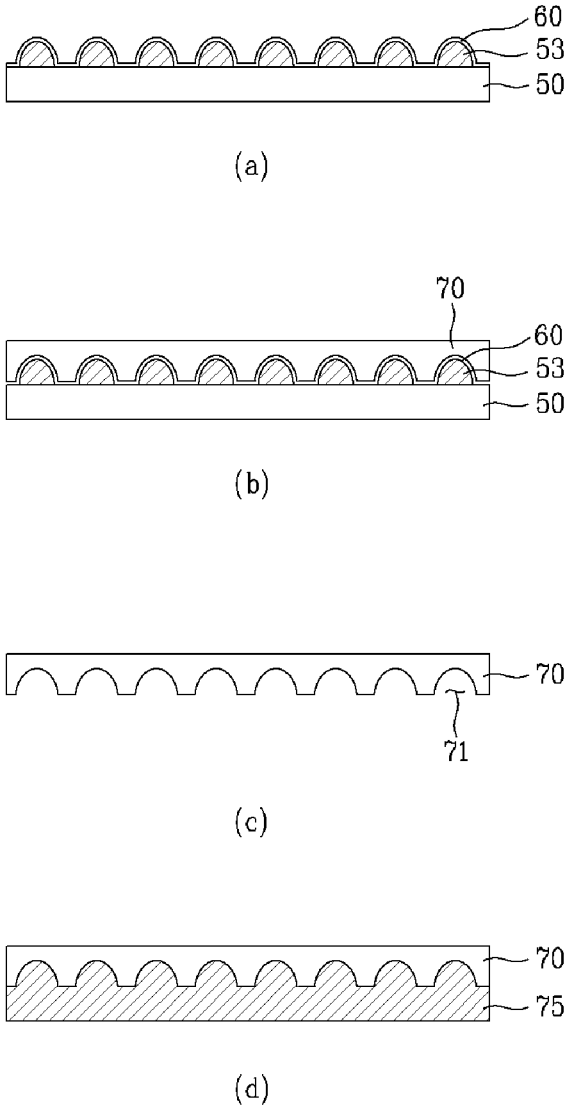
Figure 9:
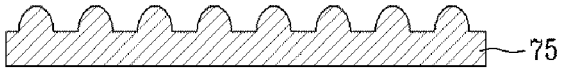
Figure 9:
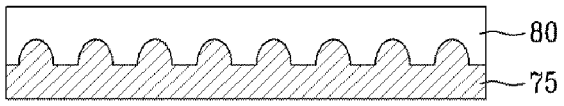
Figure 9:
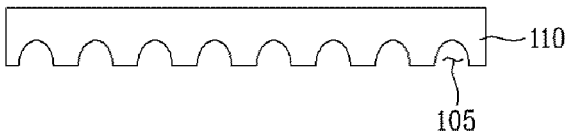
Figure 9:
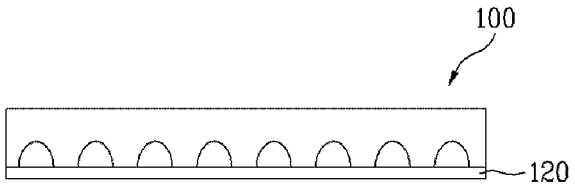

As shown in FIG. 6, the configuration of the humidity adjusting part 200 mounted in the storage container 32 will be described.

The storage container 32 includes the extended part 230 longitudinally extended from a side surface thereof in the forward/rearward direction, the projections 220 projected from the extended part 230 downward, spaced apart a predetermined distance from each other, and the accommodating spaces 210 formed between the projections.

Here, the accommodating space 210 has a minute micrometer size and the minute particles composing the humidity may be accommodated in the accommodating spaces 210.

That is, if the humidity inside the storage container is increased as shown in FIG. 6A, predetermined parts of the moisture spread in the inner space 35 of the storage container are condensed in entrance portions of both the projections 220 and the accommodating spaces 210.

The condensate is re-drawn into and accommodated in the accommodating spaces 210 by the capillary phenomenon.

If the moisture inside storage container 32 is decreased as shown in FIG. 6B, the condensate accommodated in the accommodating spaces 210 may move toward entrance portions of the accommodating spaces.

Hence, the condensate is evaporated into steam shaped material to surround the storage objects (S) stored in the storage container 32.

That is, if the humidity inside the storage container 32 is increased, the humidity adjusting part 200 performs a moisture sorption function. If the humidity is decreased, the humidity adjusting part 200 performs a moisture-proofing function to be functioned to maintain the humidity.

As follows, a method of fabricating the decorative member 100 will be described.

As shown in FIGS. 7A to 7D, a photoresist 52 is coated on a substrate 50 having a predetermined area and a mask 52 is arranged on the photoresist 51. Hence, UV beam is emitted and then a minute pattern 53 is formed on the substrate by the photoresist, corresponding to a pattern line formed in the mask 52.

As a predetermined time passes, a surface tension of the photoresist makes an end of the minute pattern curved circularly to be concave such that an upper end of the minute pattern may have a predetermined curvature.

Hence, as shown in FIGS. 8A to 8E, the pattern 53 formed with the curvature and a predetermined metal seed layer 60 are formed on the substrate 50. After that, the metal seed layer 60 is plated with metal such as Nickel to form a master stamp 70 and the formed master stamp 70 is isolated.

Such the master stamp 60 may be an original form of the display plate (110, see FIG. 3) composing the decorative member 100.

As another metal different from the metal of the master stamp 70 is located below the master stamp 70, a replication mold 75 may be fabricated, having an opposite pattern of the minute pattern 71 formed in the master stamp 70 replicated therein.

As shown in FIGS. 9A to 9D, fluidal resin material 80 is placed in the replication mold 75 having the opposite pattern replicated therein. After that, a pattern having a predetermined curvature may be formed in the resin material 80.

If the resin material 80 having the curvature is hardened, the display plate 110 of the decorative member 110 according to the present invention is fabricated and the pattern having the curvature may be the path part 105.

Hence, the partition plate 120 is attached to the display plate having the path part 105 to close the rear portion of the path part 105 and the accommodation part (130, see FIG. 3) is mounted to complete the decorative member 100.

The invention claimed is:

1. A refrigerator comprising: a storage container provided in a storage chamber; and a decorative member provided in the storage container, the decorative member configured to generate light refraction and configured to be capable of displaying humidity inside the storage container according to the movement degree of condensate; wherein the decorative member comprises a path part formed in a capillary tube shape to generate a capillary phenomenon moving the movement of the condensate, and wherein the decorative member is configured to guide a movement of condensate condensed in the storage container; wherein the path part is configured to induce the refraction, and the decorative member further comprises: a display plate comprising a plurality of path parts; a partition plate provided in rear of the display plate to cover rear portions of the path parts; and a transmitting part provided in a front portion of the display plate; and wherein the decorative member comprises an accommodation part provided below the display plate to accommodate condensate condensed from the humidity inside the storage container.

2. The refrigerator as claimed in claim 1, wherein the path parts are arranged vertically, spaced apart a predetermined distance from each other in parallel.

3. The refrigerator as claimed in claim 1, wherein the path parts are formed concavely in a rear surface of the display plate to fill condensate or air therein.

4. The refrigerator as claimed in claim 3, wherein the path part has a semicircular cross section to have a predetermined curvature.

5. The refrigerator as claimed in claim 1, wherein the width of the path part is 1-100/Ira to induce the capillary phenomenon and light refraction.

6. The refrigerator as claimed in claim 1, wherein the accommodation part comprises an accommodating groove accommodating dewdrops condensedly formed from the humidity and a wall surrounding the accommodating groove to prevent the dewdrops from overflowing.

7. The refrigerator as claimed in claim 1, wherein the decorative member is provided to display humidity inside the storage container according to the height of condensate lifted upward along the path parts.

8. The refrigerator as claimed in claim 1, wherein the decorative member is provided in an upper portion of the front wall of the storage container.

9. The refrigerator as claimed in claim 1, further comprising:

a humidity adjusting part provided in the storage container, the humidity adjusting part accommodating the moisture inside the storage container or discharging the accommodated moisture to adjust the humidity inside the storage container.

10. The refrigerator as claimed in claim 8, wherein the humidity adjusting part comprises:

an extended portion extended from a side wall of the storage container in a forward/rearward direction;

a plurality of projections projected from the extended portion downward, spaced apart a predetermined distance from each other; and a plurality of accommodating spaces formed between the projections to accommodate the condensate.

11. The refrigerator as claimed in claim 1, further comprising:

a transparent window for making visible the storage objects accommodated in the storage container.

* * * * *